US007091946B2

(12) United States Patent
Tsutsui et al.

(10) Patent No.: US 7,091,946 B2
(45) Date of Patent: Aug. 15, 2006

(54) DISPLAY DEVICE

(75) Inventors: Yusuke Tsutsui, Gifu (JP); Makoto Kitagawa, Gifu (JP); Mitsugu Kobayashi, Nagoya (JP)

(73) Assignee: Sanyo Electric Co., Ltd., Osaka (JP)

( * ) Notice: Subject to any disclaimer, the term of this patent is extended or adjusted under 35 U.S.C. 154(b) by 326 days.

(21) Appl. No.: 10/454,777

(22) Filed: Jun. 5, 2003

(65) Prior Publication Data

US 2004/0041802 A1 Mar. 4, 2004

(30) Foreign Application Priority Data

Jun. 7, 2002 (JP) ..... 2002-167347
Jun. 7, 2002 (JP) ..... 2002-167348

(51) Int. Cl.
*G09G 3/36* (2006.01)

(52) U.S. Cl. ..... 345/100; 345/211; 345/212

(58) Field of Classification Search ..... 345/626, 345/100, 92, 211–212
See application file for complete search history.

(56) References Cited

U.S. PATENT DOCUMENTS 6,522,319 B1 * 2/2003 Yamazaki ..... 345/103
2001/0052887 A1 * 12/2001 Tsutsui et al. ..... 345/87
2002/0126107 A1 9/2002 Inoue et al.
2002/0175887 A1 11/2002 Yamazaki
2002/0190944 A1 * 12/2002 Morita ..... 345/100

FOREIGN PATENT DOCUMENTS

| | | |
|---|---|---|
| CN | 1262761 | 8/2000 |
| JP | 2000-276093 | 10/2000 |
| JP | 2002-99262 | 4/2002 |

* cited by examiner

*Primary Examiner*—Sumati Lefkowitz
*Assistant Examiner*—Ke Xiao
(74) *Attorney, Agent, or Firm*—Morrison & Foerster LLP

(57) ABSTRACT

A mask circuit is provided in a display device having a plurality of pixels. The mask circuit supplies a video signal to each of the pixels in a partial display area selected based on a display area selection signal, and prevents the supply of the video signal to each of the pixels in a background display area. Accordingly, this display device displays an arbitrary pattern at an arbitrary position of the display panel of the display device. In addition, an inverting controlling circuit is provided for inverting the background display signal supplied to each of the pixels in the background display area for each frame. The power consumption of the display device can be reduced.

12 Claims, 12 Drawing Sheets

FIG.2A Waveform diagram of horizontal scanning
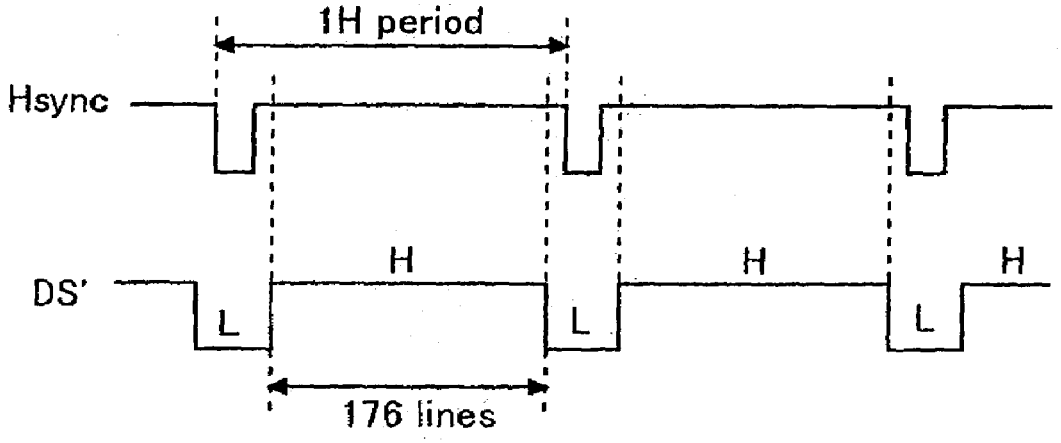
FIG.2B Waveform diagram of vertical scanning
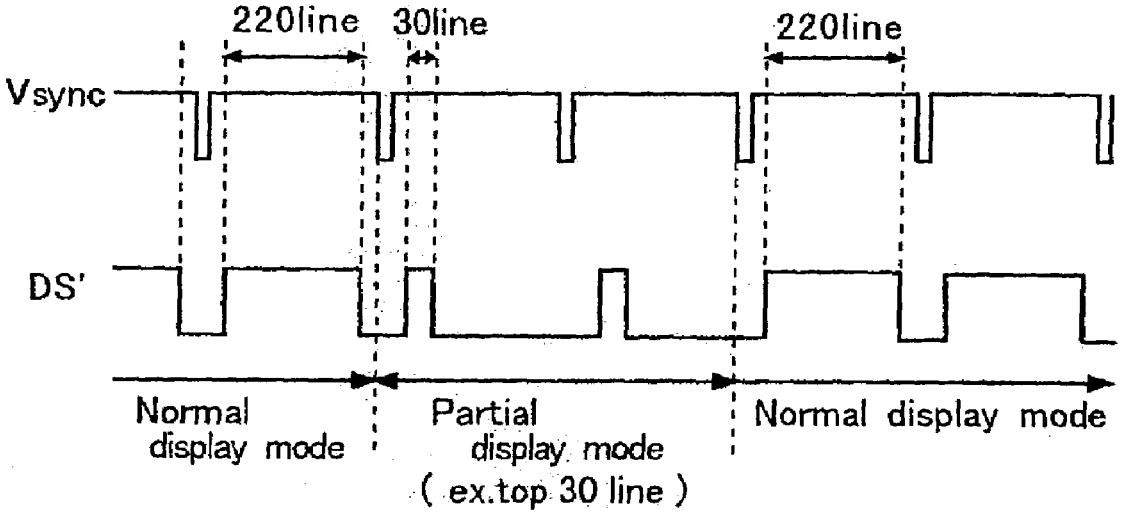

| DS' | R0~2 | OUT0~2 |
|---|---|---|
| L | — | ALL H |
| H | L/H | L/H |

FIG.11A Partial display
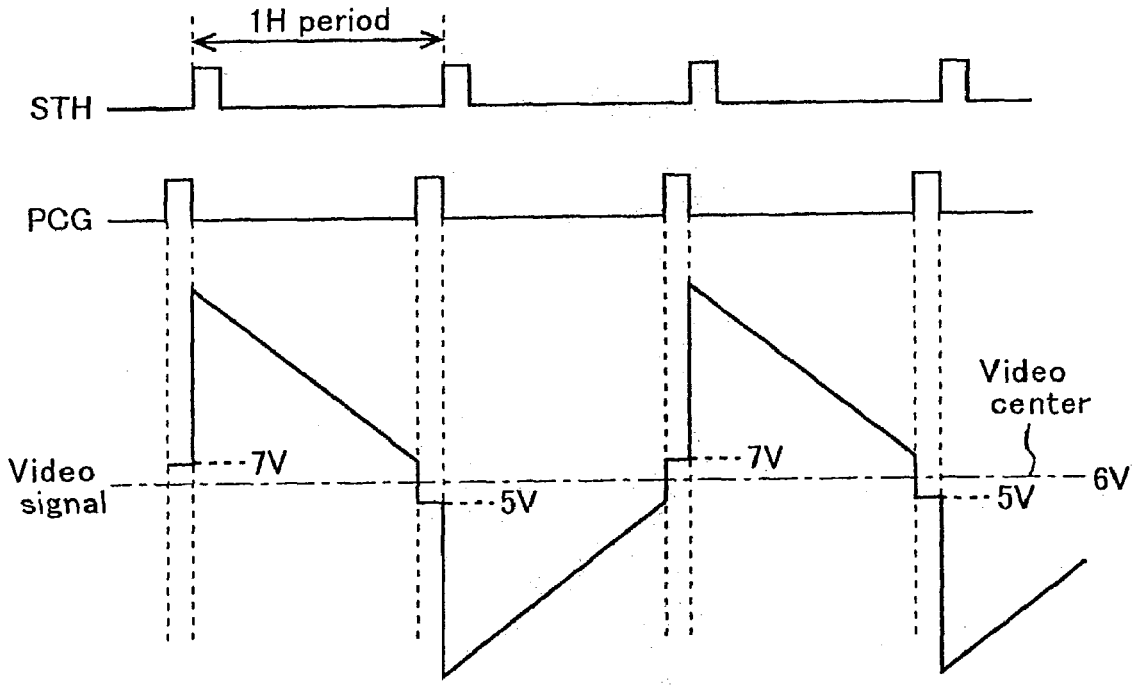
FIG.11B Background display
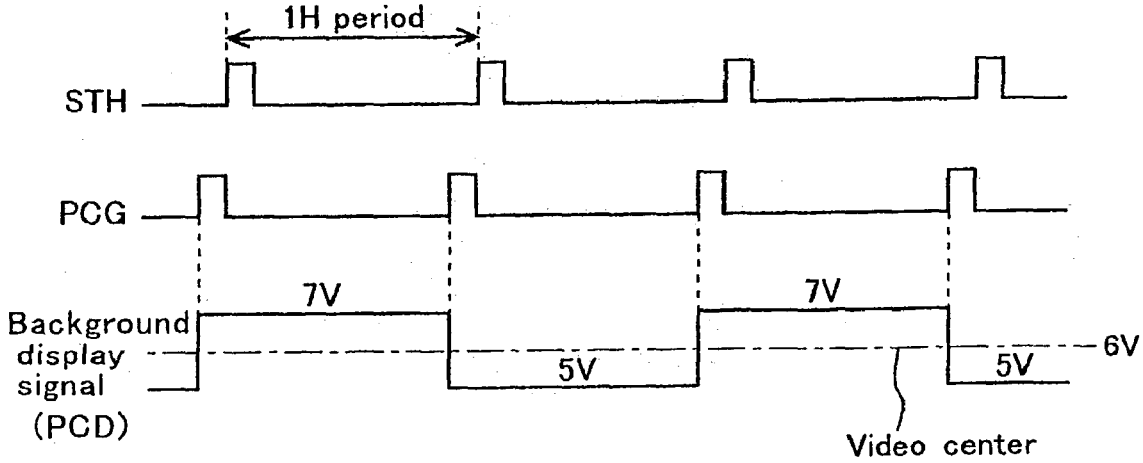

DISPLAY DEVICE

BACKGROUND OF THE INVENTION

1. Field of Invention

This invention relates to a liquid crystal display device, especially to a liquid crystal display device with partial display function, in which only a necessary part of the display screen of the display device is used for display.

2. Description of Related Art

Further reduction of the power consumption has been sought for the portable devices. Accordingly, the display device of such devices also requires low power consumption. There has been display devices with partial display function, in which only a necessary part of the screen is used for display during a power saving mode, in order to respond to the demand for the lower power consumption. The partial display is achieved by setting a special area for displaying a fixed pattern, for example, the amount of remaining battery or the time in a display region of a liquid crystal display device. A plurality of pixels for displaying an arbitrary pattern is disposed in a matrix configuration in the display region other than the special area designated for the partial display. Only the special region for the fixed pattern is operated to display the fixed pattern during the power saving period.

A plurality of display areas that can be operated and controlled individually may be configured in the same display panel, so that only a part of the display region can be operated for making a display depending on the demand. However, the configuration with such predetermined divided areas independently controlled can not fulfill the demand of displaying an arbitrary pattern at an arbitrary position during the power saving period.

Also, the content and the position of the display during the power saving period vary depending on the type of the host device of the display device. Therefore, different kinds of display devices are developed independently according to the configuration of the display panel and driver circuit of each device.

A matrix type display device accommodates the display of an arbitrary pattern at an arbitrary position. However, the entire display region should be under the normal operation even if only the partial display is required. Therefore, this is not an effective way to lower the power consumption.

SUMMARY OF THE INVENTION

The invention provides a display device that includes a plurality of pixels and a mask circuit supplying a video signal to the pixels that are selected based on a display area selection signal and preventing the video signal from reaching the pixels that are not selected based on the display area selection signal.

The invention also provides a display device that includes a plurality of pixels and a pre-charge circuit supplying a pre-charge voltage to the pixels. A video signal is supplied to the pixels that are selected to form a partial display and the pre-charge voltage is supplied as a background display signal to the pixels that are selected to form a background display.

BRIEF DESCRIPTION OF THE DRAWINGS

FIGS. 2A and 2B show the waveforms of the display area selection signal DS' of the device of FIG. 1.

FIGS. 11A and 11B show the operation waveforms of the display device of FIG. 9.

DETAILED DESCRIPTION OF THE INVENTION

Figure 1:
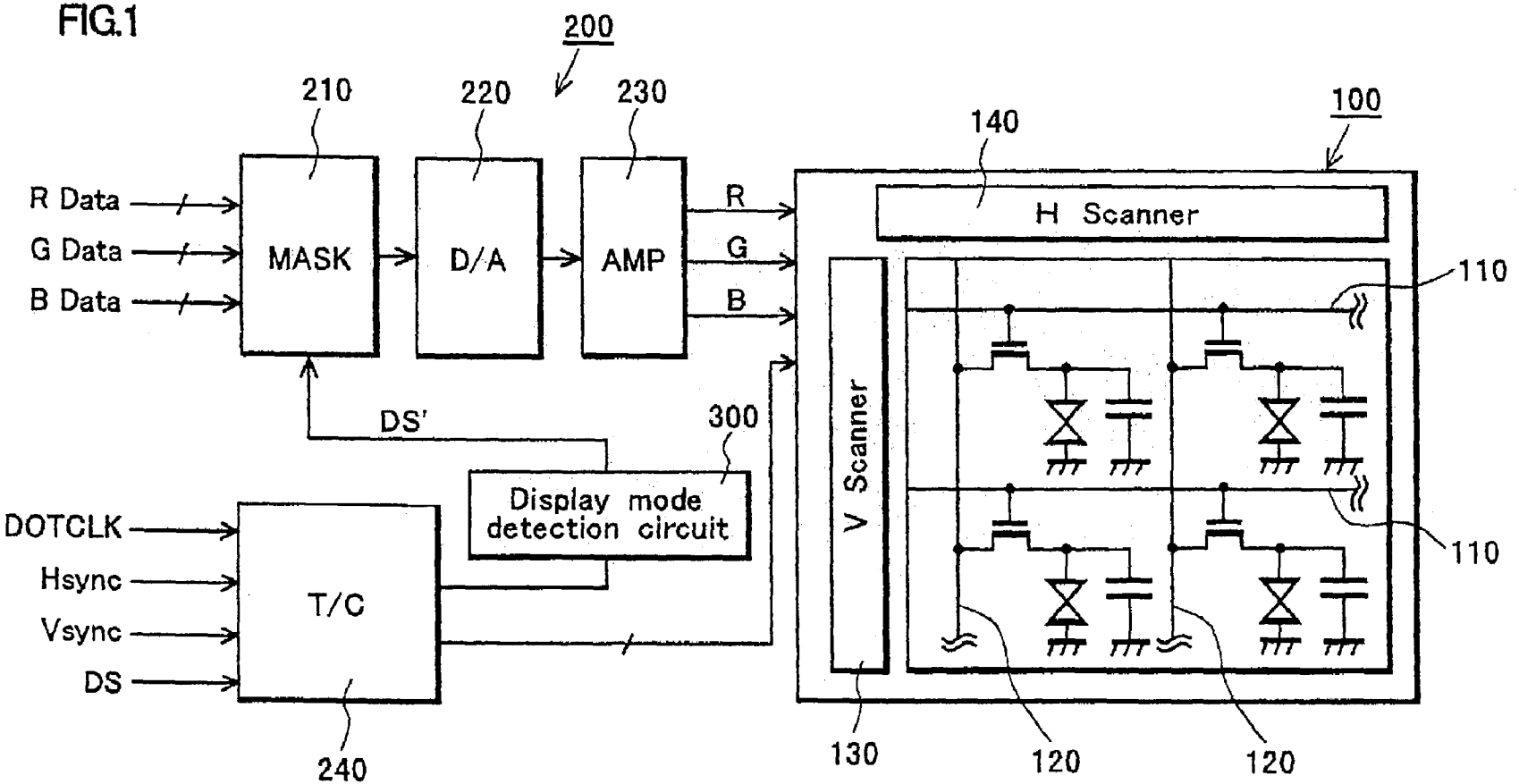
FIG. 1 shows the configuration of the display device of a first embodiment of this invention.

FIG. 1 shows the configuration of the display device of a first embodiment of this invention. A liquid crystal display panel 100 has a plurality of pixels configured in a matrix with n columns and m rows. Each pixel has a pixel selection transistor, a liquid crystal and a storage capacitor. For simplicity, only four pixels in a matrix with 2 columns and 2 rows are shown in FIG. 1.

A gate line 110 extending in the column direction is connected to the gate and a drain line 120 extending in the row direction is connected to the drain of the pixel selection transistor. A gate scanning signal is sequentially supplied from a vertical scanner (V scanner) 130 to the gate line 110 of each column, selecting the pixel selection transistor accordingly. Also, a RGB video signal is supplied from a horizontal scanner (H scanner) 140 to the drain line 120 according to a drain scanning signal, and then applied to the liquid crystal through the pixel selection transistor.

A peripheral driver circuit 200 that supplies power and variety of driver signals to the liquid crystal panel 100 is also formed. The peripheral driver circuit 200 includes a mask circuit 210 for masking the RGB video data (digital data) according to a display area selection signal DS', a DA converter 220 for converting the RGB video data coming through the mask circuit 210 into an analog video signal, and an amplifier 230 for amplifying the video signal from the DA converter. The RGB video signal amplified by the amplifier 230 is supplied to the LCD panel 100.

The mask circuit 210, for example, allows the RGB video data to pass through when the display area selection signal DS' is HIGH, and it will mask the RGB video data and output a pre-determined background display data when the display area selection signal DS' is LOW (a low level signal). In the latter case, the mask circuit 210, for example, sets forcibly the entire bits of the RGB video data HIGH as an output, corresponding to the white or black display.

The peripheral circuit 200 also includes a timing controller 240 (T/C). The timing controller 240 supplies necessary timing signals to the vertical scanner 130 and the horizontal scanner 140 of the LCD panel 100 based on the timing signal of a dot clock DOTCLK, a horizontal synchronizing signal Hsync, and a vertical synchronizing signal Vsync. The timing controller 240 also adjusts the timing of the display area selection signal DS coming from outside.

The timing adjustment is done, for example, by synchronizing the display area selection signal DS with the RGB video data. The adjusted display area selection signal DS is then supplied to the mask circuit 210. Some systems do not need the timing adjustment. In that case, the display area selection signal DS' may go through the timing controller without adjustment or may be directly fed to the mask circuit 210.

The display device with the configuration described above can switch from the partial display mode to the normal display mode by using the display area selection signal DS coming from outside. For example, when the display area selection signal DS is HIGH (a high level signal) in the entire pixel region, the device is under the normal display mode.

In the partial display mode, a partial display, in which only a part of the display panel is used for displaying display contents, is made when the display area selection signal DS is HIGH, and a background display is made by masking the RGB video data with the mask circuit 210 when the display area selection signal DS is LOW. However, since the display area selection signal DS' is fed from outside of the display device, the display device itself can not differentiate the partial display mode from the normal display mode.

Therefore, a display mode detection circuit 300 that detects the signal level of the display area selection signal DS' coming from the timing controller 240 is provided for discriminating the partial display mode from the normal display mode.

Figure 3A:
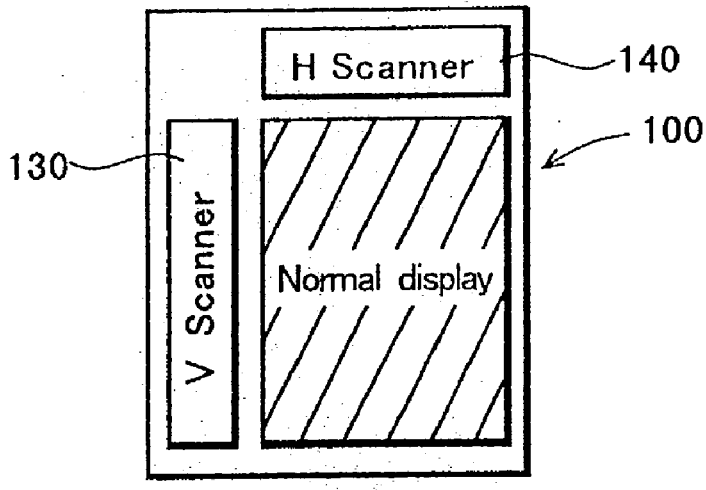
FIGS. 3A, 3B and 3C show the liquid crystal display panel of the display device of FIG. 1.
Figure 3B:
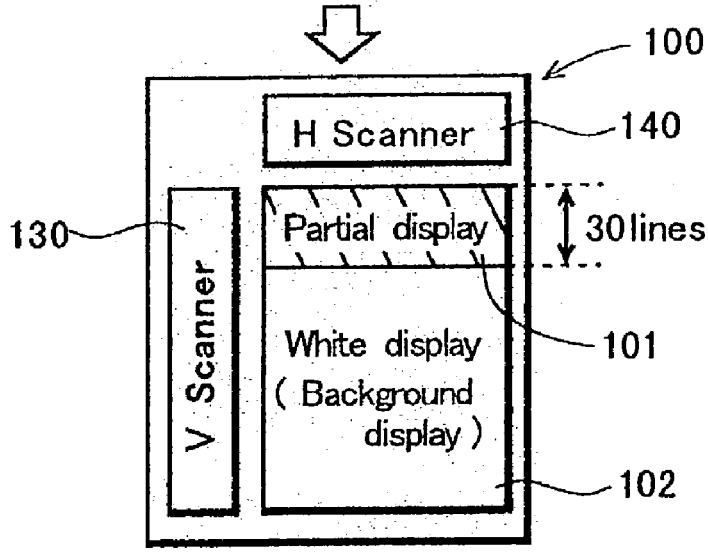
Figure 3C:
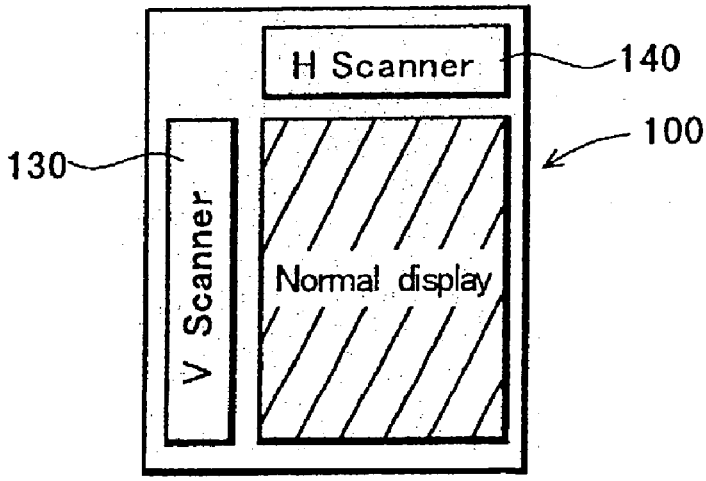

Next, the liquid crystal display panel 100 with a matrix of n columns and m rows will be explained as an example. Here, it is assumed that n is 220 and m is 176. FIGS. 2A and 2B show the waveform of the display area selection signal DS', and FIGS. 3A, 3B and 3C show the liquid crystal display panel.

The display area selection signal DS' stays HIGH only for a period necessary for scanning the 176 rows during the one H period, in terms of the horizontal scanning system (H system), as shown in FIG. 2A. In this case, the RGB video signal is written into each of the pixels through the drain line 120 of each row, making the normal display.

On the other hand, the display area selection signal DS' stays HIGH only for a period necessary for scanning and driving the entire 220 columns during one frame period, in terms of the waveform of the vertical scanning system (V system) under the normal display mode, as shown in FIG. 2B. However, FIG. 2B is only a schematic view, and the signal actually turns to LOW during a blanking period as shown in FIG. 2A.

In the normal display mode, the gate lines of 220 columns are consecutively selected during one frame period, and the RGB video signal is supplied to the drain lines 120 of 176 rows simultaneously. The entire pixels operate to make display, as shown in FIG. 3A, by writing the RGB video signal into the pixel corresponding to each column.

On the other hand, the display area selection signal DS' becomes HIGH only for a period necessary for scanning a pre-determined columns and becomes LOW for the rest of the period during one frame period under the partial display mode, as shown in FIG. 2B. This allows an arbitrary partial display area 101 to be selected. For example, the first 30 columns×the 176 rows becomes the partial display area, making the desired partial display, and the other area makes the background display as a background display area 102. In this configuration, any arbitrary area of the display panel is used as the partial display area 101 by controlling the timing of making the display area selection signal DS' HIGH.

A white display is made in the background display area 102 (see FIG. 3B) in case of a normally white liquid crystal display panel 100 that makes the white display when the voltage applied to the liquid crystal is a ground voltage (a few volts in actual operation). A black display is made in the background display area 102 in case of a normally black liquid crystal display panel 100 that makes the black display when the voltage applied to the liquid crystal is the ground voltage (a few volts in actual operation). The display will be made by the entire pixels when the operation returns to the normal display mode, as shown in FIG. 3C.

The partial display is feasible by using one signal, the display area selection signal DS' for selecting the arbitrary partial display area 101. But, it is important to suppress the power consumption by the background display area 102 during the background display operation. A line inverting operation that inverts the polarity of the video signal for each line is usually employed in a liquid crystal panel in order to prevent the deterioration of liquid crystal. However, an electric discharge takes place repeatedly at each time when the polarity of the video signal is inverted, leading to the increased power consumption by the peripheral circuits.

Therefore, this invention also offers the following two methods for the reduction of power consumption: a method to drive the background display signal by a frame inverting operation (to invert the polarity of the video signal by one frame), not the line inverting operation, and a method to utilize a pre-charge signal used in the liquid crystal panel as the background display signal. The detailed explanation on these methods will be made as a second and third embodiments of this invention, respectively.

The display mode detection circuit 300 recognizes the difference of the display modes, as described above. The circuit recognizes the display mode as the normal display mode when the display area selection signal DS' stays HIGH during the scanning of the entire 220 columns, in the example described above. And the circuit recognizes the display mode as the partial display mode when the duration of HIGH is shorter than the scanning period. Or, the circuit recognizes the display mode as the normal display mode when the display area selection signal DS' is HIGH at a timing corresponding to a pre-determined column (for example, the $100^{th}$ column). And the circuit recognizes the display mode as the partial display mode when the display area selection signal DS' is LOW at that timing. The display mode detection circuit 300 outputs an inverting controlling signal IS for switching from the frame inverting operation to the line inverting operation under the partial display mode, as explained below.

Figure 4:
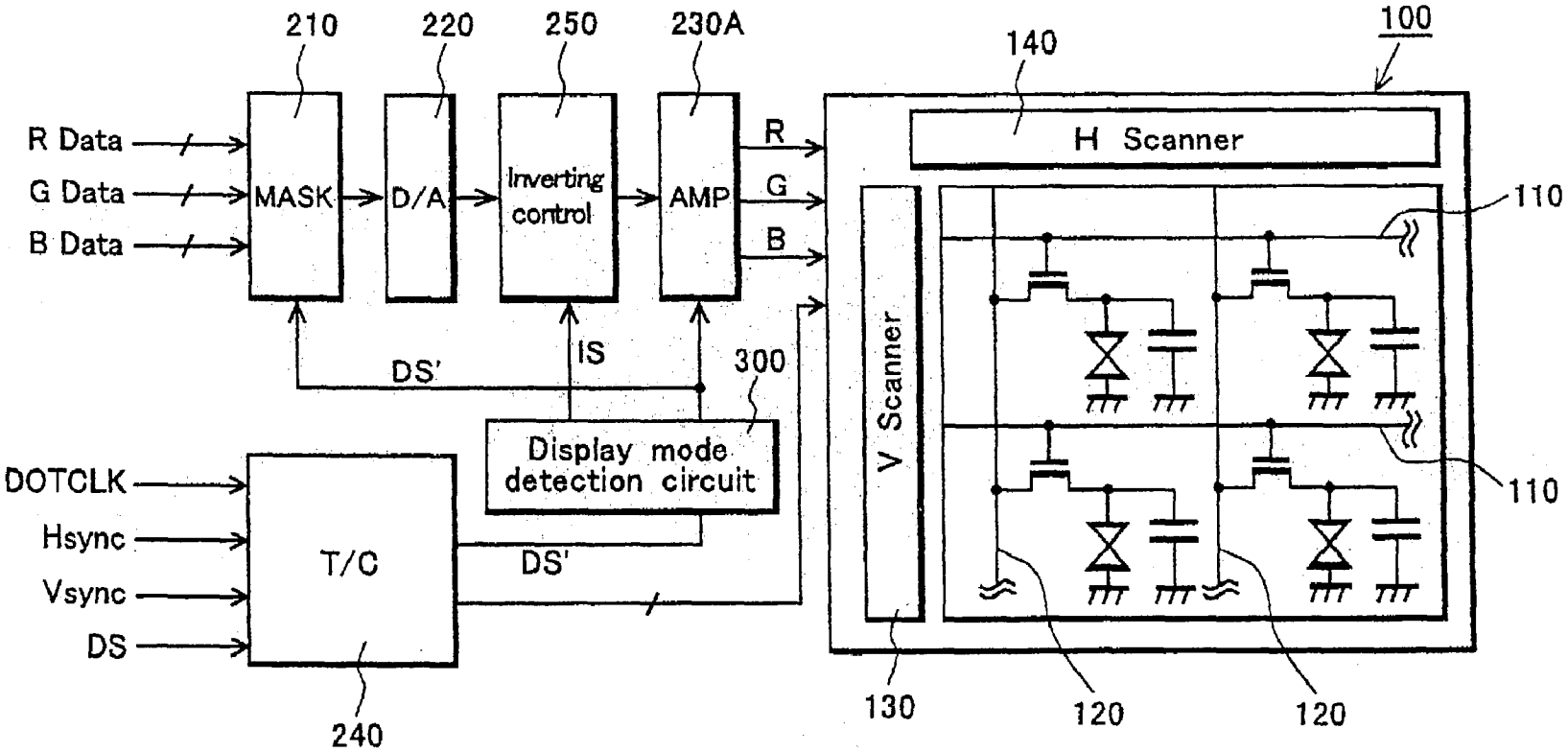
FIG. 4 shows the configuration of the display device of a second embodiment of this invention.

FIG. 4 shows a display device of the second embodiment of this invention. In this device, the polarity of the background display signal is inverted for each frame while the display area selection signal DS' is LOW in order to reduce the power consumption in the partial display mode.

An inverting controlling circuit 250 is formed for controlling the inversion of the video signal converted by the DA converter 220. During the partial display mode, this inverting controlling circuit 250 drives the video signal by the line inverting operation when the display area selection signal DS' is HIGH (during the partial display period), and drives the video signal by the frame inverting operation when the display area selection signal DS' is LOW (during the background display period).

The video signal outputted from the inverting controlling circuit 250 is then applied to the amplifier 230A capable of changing its gains. The amplifier 230A amplifies the signal by gain G1 when the display area selection signal DS' is HIGH, and amplifies the signal by gain G2 (G2<G1) when the display area selection signal DS' is LOW. Since the video signal is driven by the frame inverting operation when the display area selection signal DS' is LOW (the background display period), the necessary gain for the amplifier 230A is smaller compared to the case of the line inverting operation. Therefore, the gain of the amplifier 230A is lowered during this period for reducing the power consumption.

Figure 5:
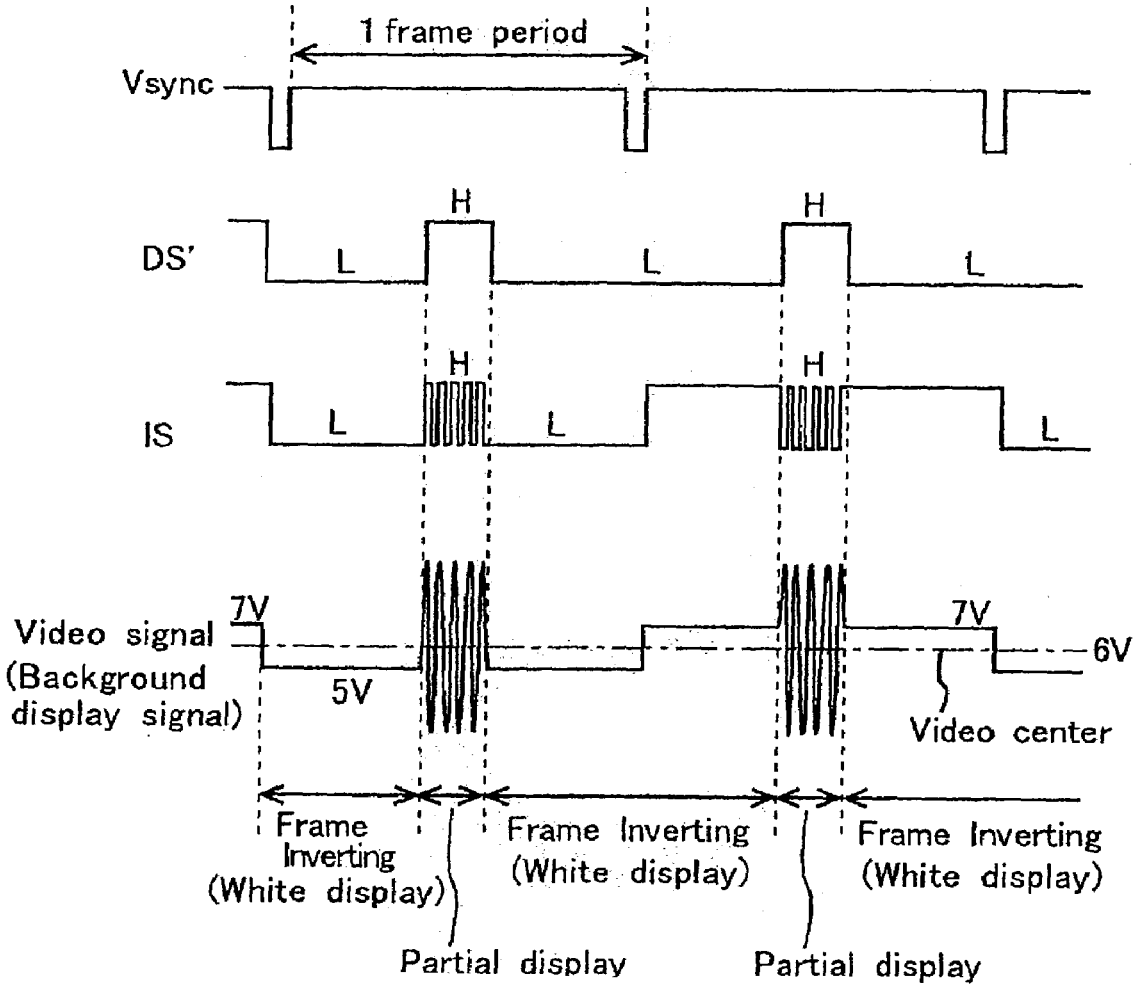
FIG. 5 shows the waveforms under the partial display mode of the device of FIG. 4.

FIG. 5 shows the waveform in the partial display mode. In the first frame period, the background display signal is, for example, at 5V, which is lower than 6V of a video center by 1 volt during the background display period where the display area selection signal DS' is LOW. Then, in the next frame period, the background display signal is 7V, which is higher than 6V of the video center by 1 volt. The polarity of the background display signal is inverted for each frame, under the partial display mode. The line inverting operation drives the video signal, as shown in FIG. 5, during the partial display period where the display area selection signal DS' is HIGH. The inverting controlling signal IS in FIG. 5 is the signal for controlling the inverting operation by the inverting controlling circuit 250, which will be explained below. It repeats the inversion for each frame period when the display area selection signal DS' is LOW, and repeats the inversion for each horizontal period when the display area selection signal DS' is HIGH.

The background display signal is the signal with +1V or −1V of the video center, in this example. It is the white display signal in the liquid crystal panel of normally white, and the black display signal in the liquid crystal panel of normally black.

Figure 6:
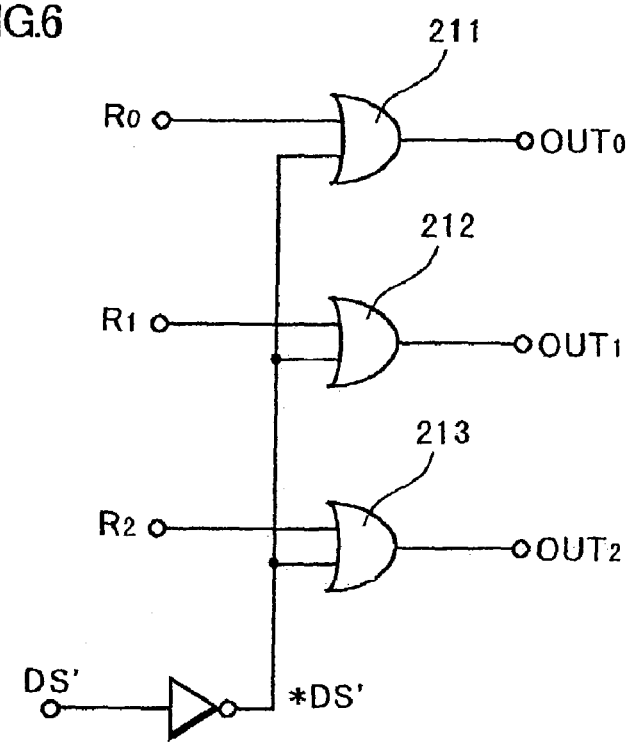
FIG. 6 is a circuit diagram of the mask circuit of the device of FIG. 5.

Next, the configurations of the mask circuit 210, the inverting controlling circuit 250, and the amplifier 230A capable of changing the gains will be explained. FIG. 6 is the circuit diagram of the mask circuit 210. This figure shows the mask circuit for R data among RGB video data. The mask circuit for other video data has the same configuration. Also, each of the RGB has 3 bits in the following explanation, but this embodiment is applicable to RGB signals with different depths as well.

The R video data R0, R1, R2 of the 3 bit signal is applied to an input terminal of each of OR circuits 211, 212, and 213, respectively. A signal *DS', the inverted signal of the display area selection signal DS' is applied to the other input terminals of the 'or' circuits 211, 212, and 213. The R video data R0, R1, R2 passes through the mask circuit intact during the partial display period where the display area selection signal DS' is HIGH, but the entire bits of the R video data R0, R1, R2 are forcibly set HIGH during the background display period where the display area selection signal DS' is LOW and outputted from an output terminal OUT0-2 as the background display data.

Figure 7A:
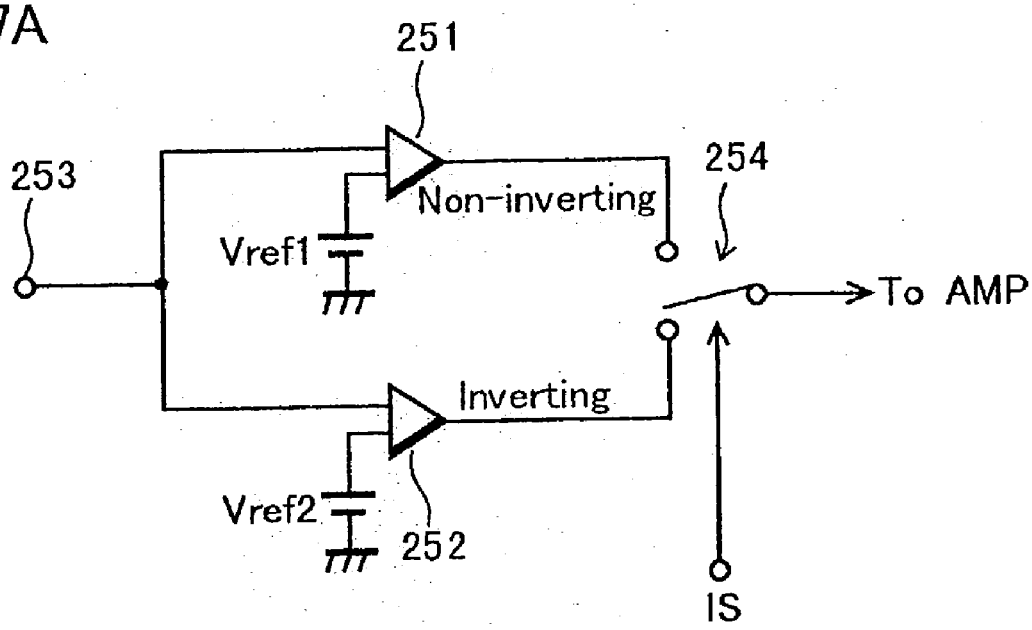
FIGS. 7A and 7B are the circuit diagrams of the inverter controlling circuit of the device of FIG. 5.
Figure 7B:
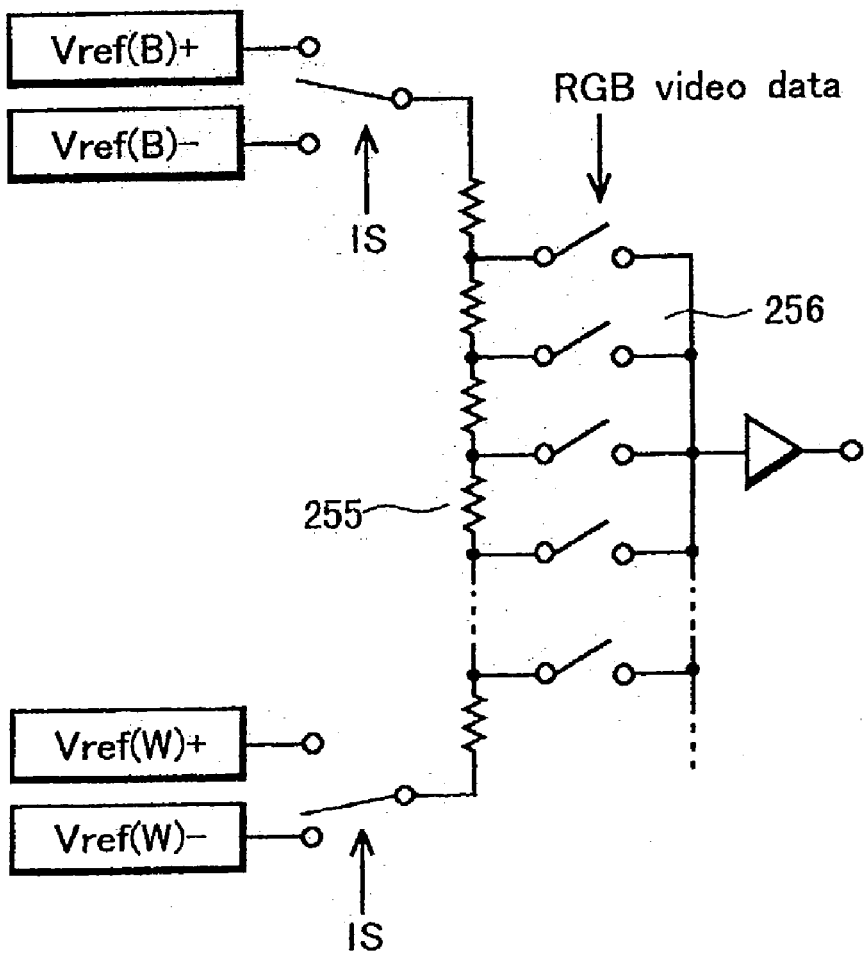

FIGS. 7A and 7B show the circuit diagrams of the inverting controlling circuit 250. The circuit of FIG. 7A has an non-inverting amplifier 251 and an inverting amplifier 252. The video signal outputted from the DA converter 220 is inputted from an input terminal 253 and then applied to the non-inverting amplifier 251 and the inverting amplifier 252. The switching element 254 can switch from the output of the non-inverting amplifier 251 to the output of the inverting amplifier 252 based on the inverting controlling signal IS described above, and also from the inverting amplifier 252 to the non-inverting amplifier 251. That is, the outputs of the non-inverting amplifier 251 and the inverting amplifier 252 are switched with each other for each line, making the line inverting operation during the partial display period where the display area selection signal DS' is HIGH. On the other hand, the outputs of the non-inverting amplifier 251 and the inverting amplifier 252 are switched with each other for each one frame and the background display signal outputted from the DA converter 220 is driven by the frame inverting operation during the background display period where the display area selection signal DS' is LOW.

FIG. 7B shows another circuit diagram to provide the inverter controlling circuit 250 of this embodiment. The DA converter 220 in this circuit has a signal inverting function. A positive black reference voltage Vref(B)+ or a negative black reference voltage Vref(B)− is switched on by the inverting controlling signal IS and supplied to one terminal of the resistance string 255 as a black reference voltage. Also, another of the positive white reference voltage Vref (W)+ or the negative white reference voltage Vref(W)− is switched on by the inverting controlling signal IS and supplied to the other terminak of the resistance string 255 as a white reference voltage. The voltage at each connecting point of the resistance string 255 is picked-up through on-and-off operations of a group of switches 256 based on the RGB data. Therefore, the DA conversion and the inversion of the signal polarity is performed in this circuit.

Figure 8A:
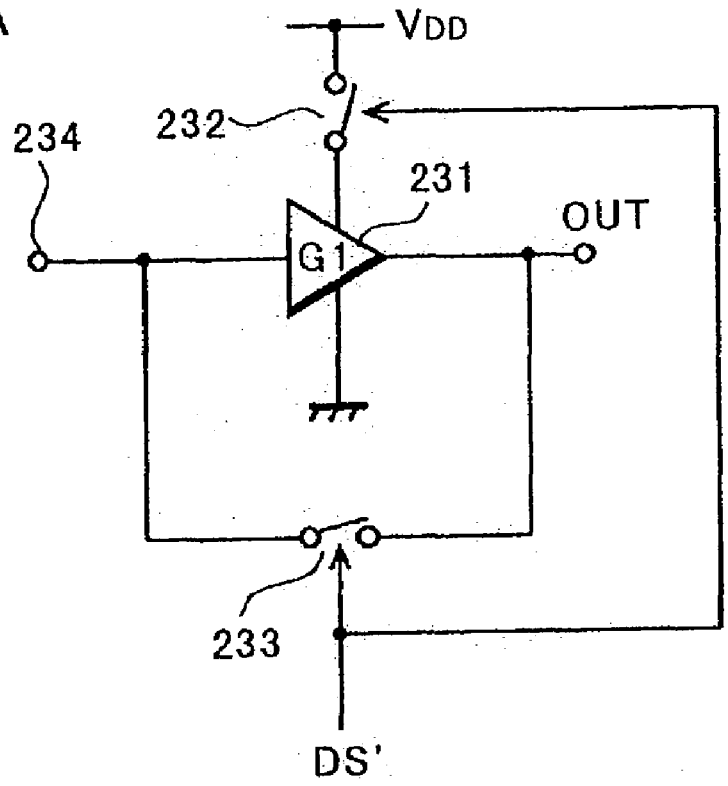
FIGS. 8A and 8B are the circuit diagrams of the amplifier with variable gain of the device of FIG. 5.
Figure 8B:
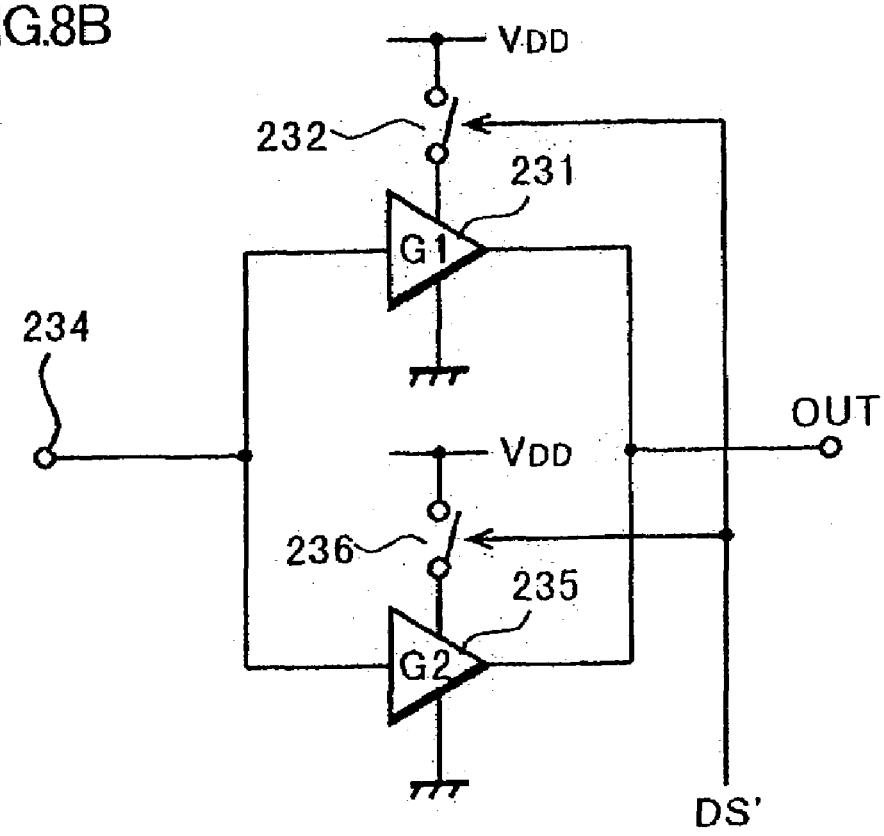

FIGS. 8A and 8B show the circuit diagram of the amplifier 230A capable of changing its gains. The circuit shown in FIG. 8B has an amplifier 231, a switching element 232 inserted between the amplifier 231 and a power source VDD, and a switching element 233 provided between the input and the output of the amplifier 231. The switching element 232 closes and the switching element 233 opens during the partial display period where the display area selection signal DS' is HIGH.

Therefore, the video signal inputted from an input terminal 234 is amplified by the gain G1 of the amplifier 231. On the other hand, the switching element 232 opens and the switching element 233 closes during the background display period where the display area selection signal DS' is LOW. Therefore, the video signal inputted from an input terminal 234 is outputted unchanged through the switching element 233. In this case, the gain G2 is 1, smaller than the gain 1 of the amplifier 231. Also, the amplifier 231 is separated from the power source VDD, reducing the static power consumption as well as the power consumption as a whole of the amplifier 230A.

Another example of the circuit configuration is shown in FIG. 8B. The amplifier 235 with the gain G2 (G2<G1) is formed in place of the switching element 233. The switching element 232 closes and the switching element 236 opens during the partial display period where the display area selection signal DS' is HIGH. Therefore, the video signal inputted from an input terminal 234 is amplified by the gain G1 of the amplifier 231. The switching element 232 opens and the switching element 236 closes during the background display period where the display area selection signal DS' is LOW. The video signal inputted from an input terminal 234 is amplified by the gain G2 of the amplifier 235.

Figure 9:
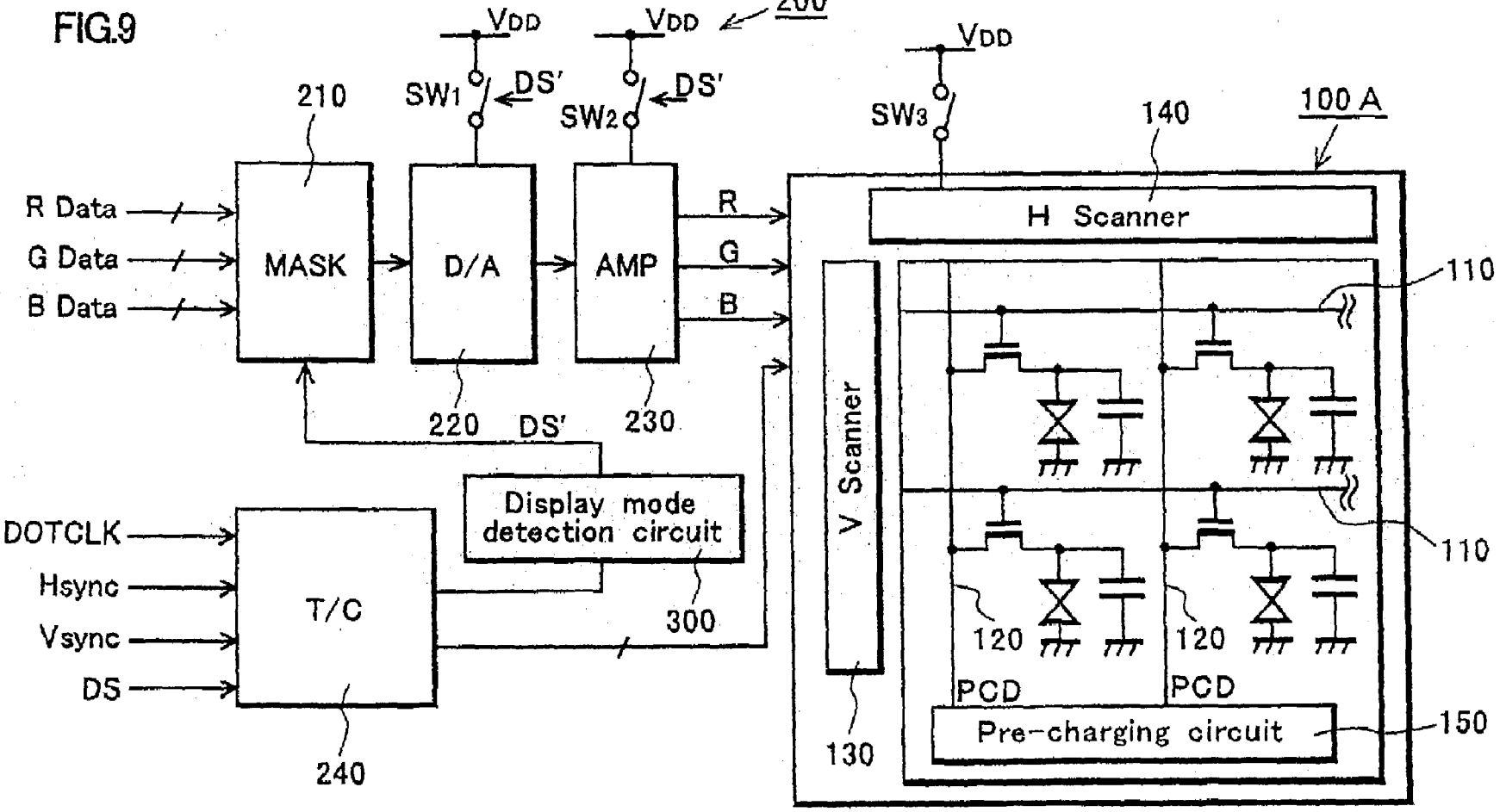
FIG. 9 shows the configuration of the display device of a third embodiment of this invention.

FIG. 9 shows a display device of the third embodiment of this invention. A pre-charge signal PCD of this liquid crystal panel 100 is also used as the background display signal in this embodiment for reducing the power consumption under the partial display mode.

A pre-charge circuit 150 that outputs the pre-charge signal to the drain line 120 is provided in the liquid crystal panel 100A. A pixel transistor turns on when the corresponding gate line 110 is selected during one horizontal period in the active matrix liquid crystal panel. The display at each of the pixels is determined by writing in the video signal applied to the drain line 120 into each pixel through the pixel transistor.

However, since the polarity of the video signal applied to the drain line 120 is inverted for each one horizontal period when operated by the line inverting operation, it is better to set the voltage of the drain line 120 exactly at the voltage of the video signal to be written in after the one horizontal period. Therefore, the pre-charge operation, by which the voltage similar to that of the video signal written into the drain line 120 during the continuous one horizontal period is written into each of the drain lines 120, is performed.

The background display is made by utilizing the pre-charge signal PCD as the background display signal in this embodiment. The power consumption is reduced by stopping the operation of the DA converter 220 that convert the video signal from the mask circuit 210 into an analog signal, the amplifier 230 that amplifies the video signal converted into the analog signal, and the horizontal scanner 140 during the background display period where the display area selection signal DS' is LOW.

The DA converter 220, the amplifier 230 and the horizontal scanner 140 do not need to operate during the background display period. Therefore, switches SW1, SW2, and SW3 for separating these circuits from the power source VDD are provided for each of the circuits. These switches SW1, SW2, and SW3 opens to separate the circuits from the power source VDD when the display area selection signal DS' is LOW.

Figure 10:
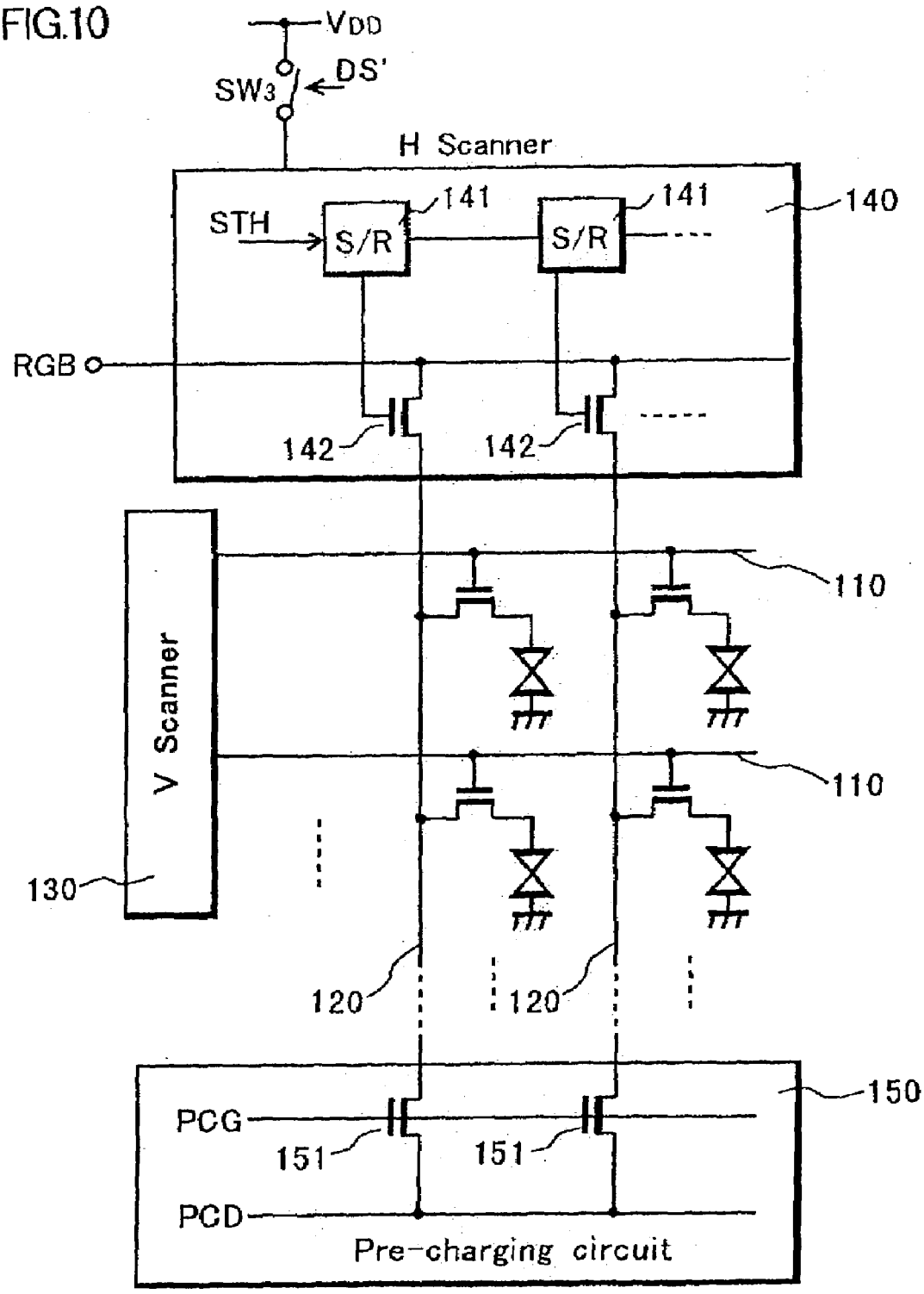
FIG. 10 is a circuit diagram of the liquid crystal display panel of the device of FIG. 9.

FIG. 10 is a detailed circuit diagram of the liquid crystal panel 100A of this embodiment. The horizontal scanner 140 has a shift resistor 141 that sequentially shifts a vertical start pulse STH based on a shift clock and a sampling TFT 142 with a gate provided with a sampling clock outputted from each of the shift resistors 141. The RGB video signal is sequentially outputted to the drain line 120 corresponding to the sampling clock. The pre-charge circuit 150 that outputs the pre-charge signal PCD to the drain line 120 has a pre-charge TFT 151 controlled by a pre-charge controlling signal PCG. The pre-charge TFT 151 turns on when the pre-charge controlling signal PCG is HIGH, outputting the pre-charge signal PCD to the entire drain lines 120.

FIGS. 11A and 11B show the operation waveform of the display device of this embodiment. The pre-charge controlling signal PCG becomes HIGH immediately before the one horizontal period and the drain line 120 is pre-charge beforehand during the partial display period, as shown in FIG. 11A. Then, the video signal is supplied to the drain line 120 through the sampling TFT 142, and written into each pixel of the corresponding column. The video signal is pre-charged to become 5V with the polarity reversed against the video center right before the next one horizontal period.

On the other hand, the pre-charge controlling signal PCG becomes HIGH immediately before the one horizontal period and the drain line 120 is pre-charge beforehand during the background display period, as shown in FIG. 11B. The video signal is masked and the signal pre-charged to 7V level is written into each pixel of the corresponding column during the next 1H period. The video signal is pre-charge to become 5V with the polarity reversed against the video center right before the following one horizontal period. Then, the video signal is masked and the signal pre-charged to 5V level is written into each pixel of the corresponding column during the next one horizontal period. Furthermore, the DA converter 220, the amplifier 230 and the horizontal scanner 140 stop the operation during the background display period, reducing the power consumption.

The pre-charge signal PCD is the signal with +1V or −1V relative to the video center, in this example. It is the white display signal in the liquid crystal panel of normally white, and the black display signal in the liquid crystal panel of normally black.

Figure 12:
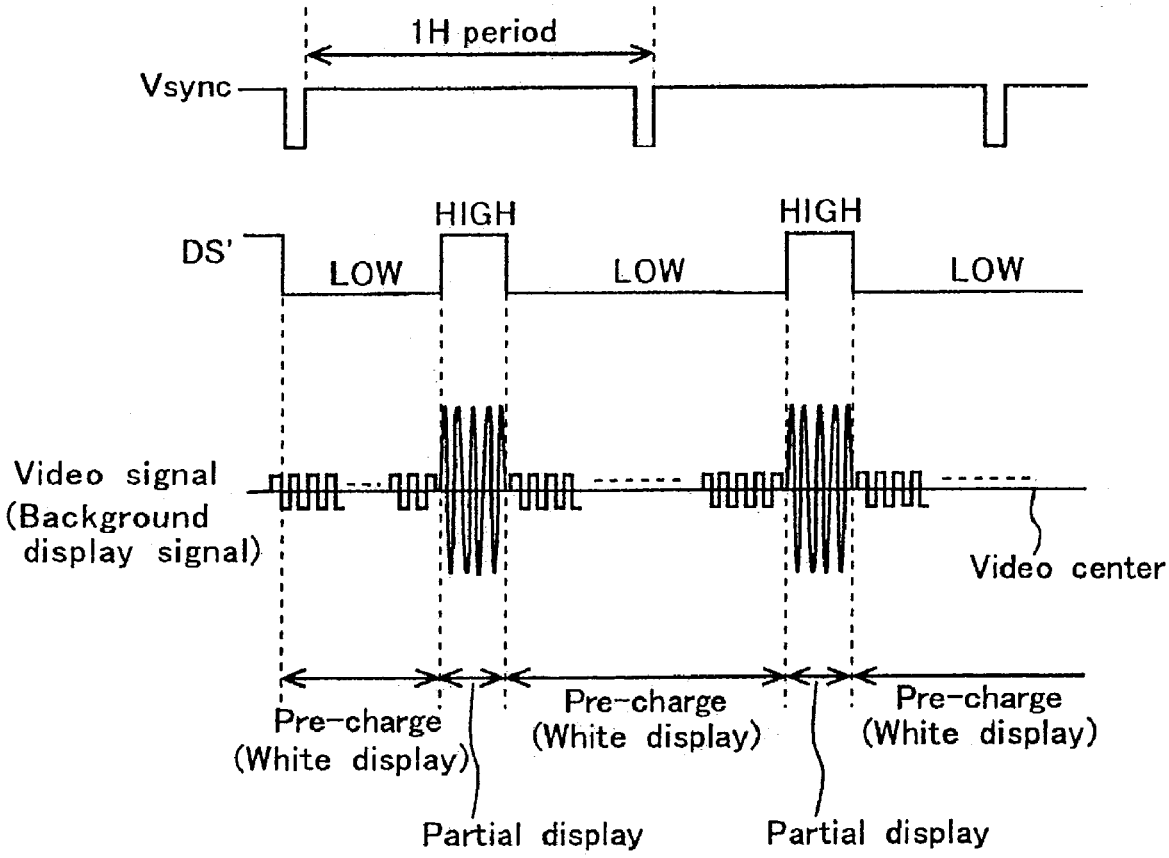
FIG. 12 shows other operation waveforms of the display device of FIG. 9.

FIG. 12 is another waveform of the display device of this embodiment. This waveform is viewed from the vertical scanning system (V system), and shows the waveform of the partial display and the background display using the pre-charge signal PCD under the partial display mode.

The signal level of the pre-charge signal PCD during the partial display period (or the normal display period) and the signal level of the pre-charge signal PCD during the background display signal are the same, in this embodiment. However, they are not necessarily be the same. Rather, the signal level of the pre-charge signal PCD can be different for each period in order to achieve the most preferable display.

Also, if a user wants to have a background with a neutral color during the partial display, it may be achieved by setting the voltage of the pre-charge signal PCD to a neutral tone. The background display with a neutral color may be displayed without operating the scanner.

What is claimed is:

1. A display device comprising:

a plurality of pixels;

a mask circuit supplying a video signal to pixels that are selected based on a display area selection signal and preventing the video signal from reaching pixels that are not selected based on the display area selection signal, a background display signal being applied to the unselected pixels; and an inverting controlling circuit inverting a polarity of the background display signal for each frame of a display sequence, wherein the inverting controlling circuit comprises a non-inverting amplifier provided with the video signal, an inverting amplifier provided with the video signal and a switching element selecting as an output of the inverting controlling circuit an output of the non-inverting amplifier or an output of the inverting amplifier in response to the display area selection signal.

2. The display device of claim 1, wherein the background display signal is a white display signal or a black display signal.

3. The display device of claim 1, further comprising an amplifier amplifying the video signal and changing a gain of the amplifying in response to the display area selection signal, the gain of the background display signal being smaller than the gain of the video signal.

4. The display device of claim 1, further comprising a display mode detection circuit differentiating a partial display mode from a normal display mode by detecting a signal level of the display area selection signal.

5. The display device of claim 4, wherein the display mode detection circuit differentiates the partial display mode from the normal display mode by detecting a period in which the display area selection signal stays at a pre-determined signal level.

6. The display device of claim 4, wherein the display mode detection circuit differentiates the partial display mode from the normal display mode by detecting a signal level of the display area selection signal at a pre-determined timing.

7. A display device comprising:

a plurality of pixels;

a pre-charge circuit supplying a pre-charge voltage to the pixels, a video signal being supplied to pixels that are selected to form a partial display and the pre-charge voltage being supplied as a background display signal to pixels that are selected to form a background display;

a DA converter converting the video signal into an analog signal;

a stopper circuit stopping an operation of the DA converter when the pixels selected to form the background display receive the pre-charge voltage as the background display signal; and a switch that separates the DA converter from a power source in response to a display area selection signal generated by the stopper circuit.

8. The display device of claim 7, further comprising a mask circuit supplying the video signal to the pixels selected to form the partial display based on a display area selection signal and preventing the video signal from reaching the pixels selected to form the background display based on the display area selection signal.

9. The display device of claim 7, wherein the pre-charge voltage during a partial display period is equal to the pre-charge voltage during a background display period.

10. The display device of claim 7, wherein the pre-charge voltage during a partial display period is not equal to the pre-charge voltage during a background display period.

11. A display device comprising:

a plurality of pixels;

a pre-charge circuit supplying a pre-charge voltage to the pixels, a video signal being supplied to pixels that are selected to form a partial display and the pre-charge voltage being supplied as a background display signal to pixels that are selected to form a background display;

an amplifier amplifying the video signal;

a stopper circuit stopping an operation of the amplifier when the pixels selected to form the background display receive the pre-charge voltage as the background display signal; and a switch that separates the amplifier from a power source in response to a display area selection signal generated by the stopper circuit.

12. A display device comprising:

a plurality of pixels;

a pre-charge circuit supplying a pre-charge voltage to the pixels, a video signal being supplied to pixels that are selected to form a partial display and the pre-charge voltage being supplied as a background display signal to pixels that are selected to form a background display;

a horizontal scanner generating a timing signal for supplying the video signal to the pixels;

a stopper circuit stopping an operation of the horizontal scanner when the pixels selected to form the background display receive the pre-charge voltage as the background display signal; and a switch that separates the horizontal scanner from a power source in response to a display area selection signal generated by the stopper circuit.

* * * * *